United States Patent [19]

Bergström

[11] 4,158,288

[45] Jun. 19, 1979

[54] REVOLVING CHAIN LINKS

[75] Inventor: Rolf Bergström, Ramnäs, Sweden

[73] Assignee: Bulten-Kanthal AB, Hallstahamar, Sweden

[21] Appl. No.: 864,039

[22] Filed: Dec. 23, 1977

[30] Foreign Application Priority Data

Dec. 30, 1976 [SE] Sweden ..... 7614748

[51] Int. Cl.[2] ..... B21L 19/00

[52] U.S. Cl. ..... 59/1; 59/34; 59/35 R

[58] Field of Search ..... 59/1, 3, 32, 33, 34, 59/35, 26

[56] References Cited

U.S. PATENT DOCUMENTS

| | | | |
|---|---|---|---|
| 796,916 | 8/1905 | Lelong | 59/26 |
| 802,447 | 10/1905 | Girlot | 59/32 |
| 812,281 | 2/1906 | Masion | 59/26 |

*Primary Examiner*—C. W. Lanham
*Assistant Examiner*—Gene P. Crosby
*Attorney, Agent, or Firm*—Pollock, Vande Sande & Priddy

[57] ABSTRACT

A method and a device for revolving the last chain link element of a freely hanging chain end. The chain link element is brought into contact with at least one rotating roller located under the chain end, said roller carrying the chain link element while making it rotate in its plane.

16 Claims, 3 Drawing Figures

REVOLVING CHAIN LINKS

BACKGROUND OF THE INVENTION

The invention relates to a method and a device for revolving or re-orienting the last chain link element of a freely hanging chain end, particularly in connection with the production or processing of the chain.

Normally, the production of chains is performed by letting the chain end, which is to be provided with additional links, hang down from a transport carriage and be moved by the carriage between various production stations, such as stations for bending a new link element and hooking it into the previously produced link, welding the link element, trimming the weld and possibly mounting a transverse support into the link.

To achieve fully automatic programmed production, it has proven advantageous to revolve or re-orient the link element between two such stations, e.g., between the bending station and the welding station, in order to facilitate the automatic welding operation. Thus, the link element being bent substantially into a C-shape hangs in a vertical plane with its longitudinal axis oriented vertically when it leaves the bending and hooking station, whereas at the welding station the link element is preferably oriented in a vertical plane with its longitudinal axis oriented horizontally so that the welding point is positioned underneath the lower end of the next preceding link.

SUMMARY OF THE INVENTION

The inventive method and device enables such a re-orientation of the link element or any other kind of re-orientation or revolution of the last link or link element, which is caused to rotate in its own plane. In the above-mentioned situation, the link element would normally be rotated one quarter of a revolution, but in principle the extent of rotary motion (a part of a revolution or several revolutions) can be chosen at will. Thus, the invention can be used e.g., for quality inspection of the link, which can then be rotated adjacent a stationary inspection device, e.g., a device operating with electromagnetic radiation, supersonic waves or the like, such as an X-ray inspection device. If the link is substantially oval and is to hang in the second last link in its new position, the rotary motion must comprise a multiple of a quarter revolution, unless a temporary bond is used.

The invention will now be explained with reference to the accompanying drawings, which illustrate a preferred embodiment of the inventive device.

DESCRIPTION OF A PREFERRED EMBODIMENT

Figure 1:
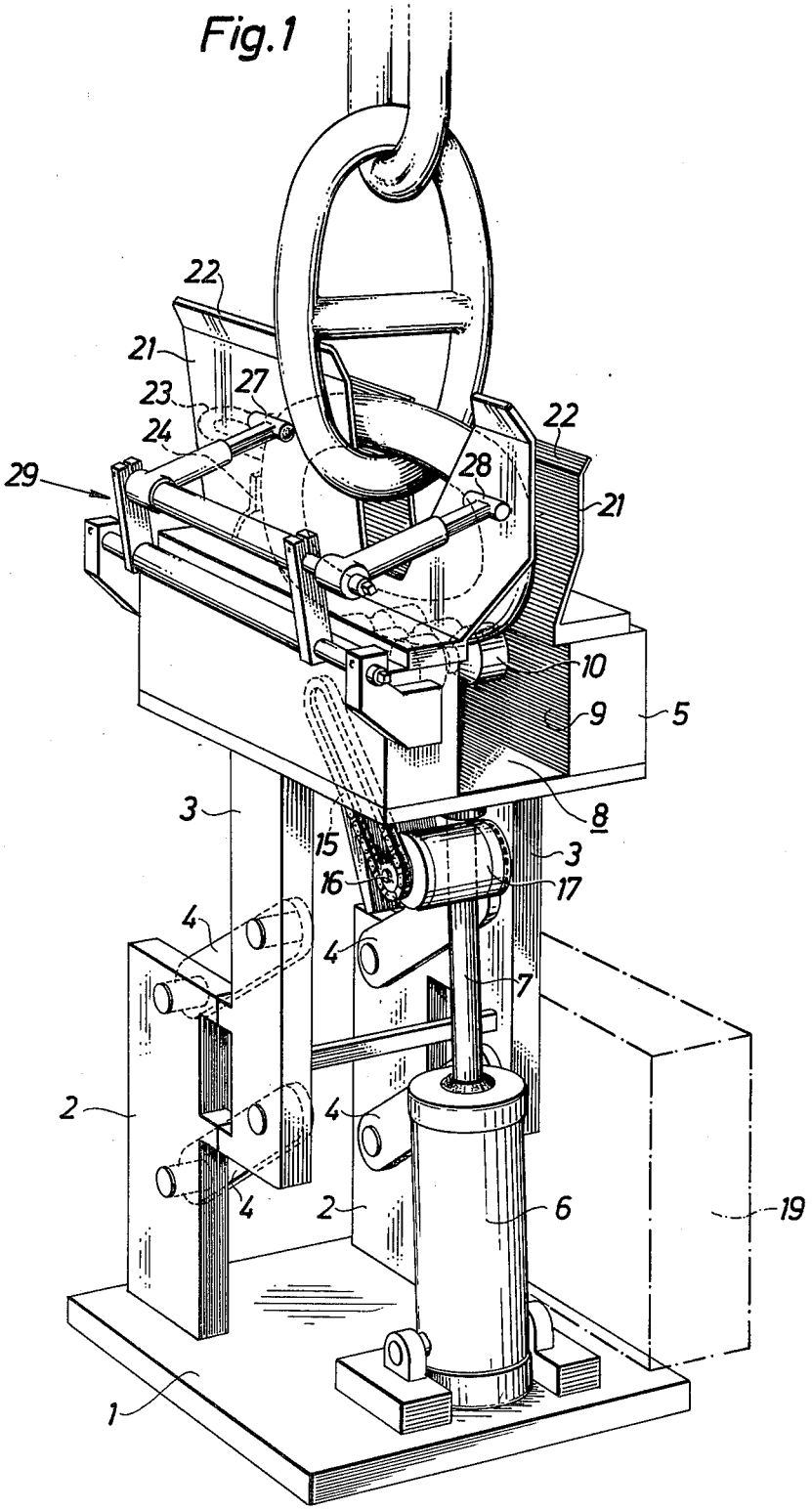
FIG. 1 shows the device in perspective view.
Figure 2:
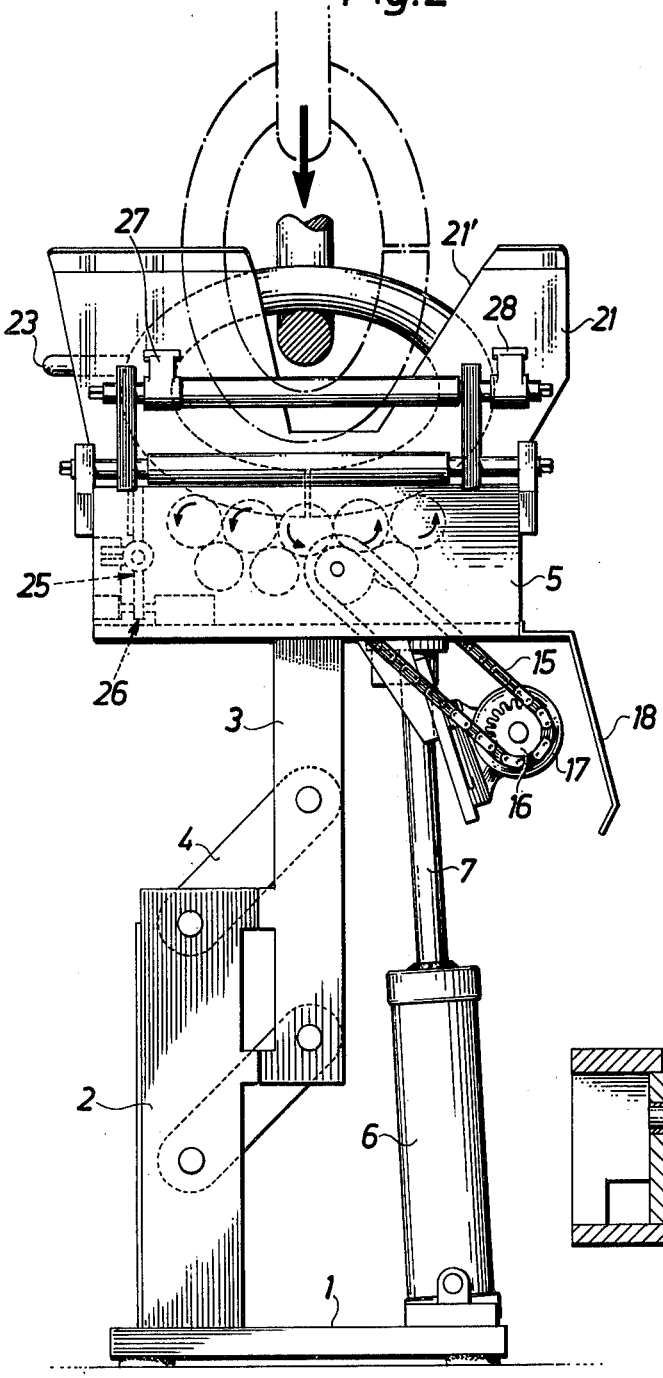
FIG. 2 shows the device in elevation.

The device shown in FIGS. 1 and 2 is mounted on a base plate 1, onto which two stationary support posts 2 are fastened. The supporting structure also comprises a movable part formed by two movable support posts 3, which are guided by linkage elements 4 and carry a tabel 5 which is elevated and lowered by means of a pneumatic actuating cylinder 6. The lower part of the cylinder 6 is pivotally mounted on base plate 1, whereas its piston rod 7 is pivotally connected to the bottom of table 5.

Figure 3:
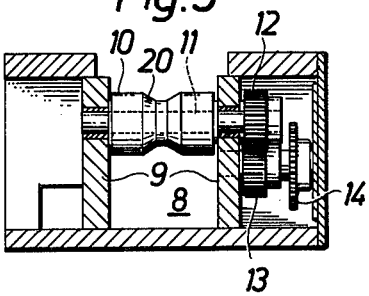
FIG. 3 shows one of the driving rollers of the device.

The vertically movable table 5 has a longitudinal, central recess 8, in the side walls 9 of which a number of driving rollers 10 are journalled each on a horizontal shaft 11 (see FIG. 3). The driving rollers 10 are spaced adjacent to one another along recess 8, jointly forming a driving roller bed. The driving rollers 10 rotate synchronously during the operation by means of gears 12 mounted on shafts 11, these gears meshing with intermediate gears 13. A sprocket 14 is mounted on the shaft of one of these intermediate gears 13' and is drivingly connected, via a driving chain, to a sprocket 16 on the drive shaft of an electric motor 17. The motor 17 is mounted underneath table 5 inside a protective hood 18 (FIG. 2). The control equipment for cylinder 6 and motor 17 is arranged in a box 19 schematically indicated in FIG. 1.

As appears from FIG. 3, each driving roller 10 has a circumferential guide groove 20 the cross sectional form of which is adapted to the cross section of the chain link carried and rotated by the driving rollers, as will be described further below.

Adjacent to recess 8 and driving rollers 10, the top of the table 5 is provided with two substantially vertical side guide plates 21, the upper edges 22 of which are bent outwardly and upwardly. Each side guide plate 21 has a cut out portion 21' for receiving the second last link of the chain end, as best shown in FIG. 1.

Further, the device comprises an end stop 23 for the link or link element to be re-oriented as well as a sensor tab 24 (FIG. 1) located below the end stop and fastened to the upper arm of a pivotally mounted lever 25 (FIG. 2) the lower arm of which actuates a switch 26 connected to the control equipment in box 19 so as to stop motor 17 and driving rollers 10 when the link element hits sensor tab 24 and the end stop 23 in the position shown in FIGS. 1 and 2.

In order to sense the vertical position of the next preceding link, the device is provided with optical sensing means comprising a transmitter 27 and a receiver 28 synchronously positionable vertically and horizontally by means of an adjustment mechanism 29.

The device operates in the following manner with reference to the introductory part of the specification: A chain end hanging down from a carriage and having a link element oriented vertically at its lower end after bending and hooking into the previous link, as shown in dotted lines at the top of FIG. 2, is moved by the carriage to a position right above the driving roller bed with its rollers 10. The chain end is lowered, by feeding means arranged on the carriage, towards the driving roller bed of the table 5, which has been actuated into its upper position, shown in FIGS. 1 and 2. The motor 17 drives rollers 10 in a counter-clockwise direction, as seen in FIG. 2. During the lowering process, the link element is guided between the side guide plates 21 and, with its lowest part, first contacts one or more of the centrally located rollers 10 of the driving roller bed, which during a continued lowering of the chain end now carries the link element and, due to the rotation of the rollers, causes the link element to rotate clockwise, as seen in FIG. 2, in its own plane. During this rotary motion the link element is guided partly by the central guide groove 20 of the rollers, and partly between the side guide plates 21. When the link element has reached the position shown in FIG. 1, (the left) one of its end portions first contacts resilient sensor tab 24 and, shortly thereafter, end stop 23. Meanwhile, the next preceding link has entered into recesses 21' of guide plates 21, any possible malpositioning in the transverse direction (parallel to the longitudinal axis of driving roller bed) being corrected by the guidance of the inclined edges of the respective recess 21'. Substantially at the same time as the last link element contacts end stop 23, the means for sensing the vertical position of the next preceding link is activated by interruption of the light beam between transmitter 27 and receiver 28 whereby a signal is given to the feeding means of the carriage to stop the lowering of the chain end. When tab 24 has been contacted by the link element and the light beam has been interupted by the next preceding link, the driving of rollers 10 is stopped, whereafter the link element remains in the position shown in FIG. 1.

Subsequently, the chain end is to be brought to a welding station. This could of course be achieved by hoisting the chain end again, but, in order to avoid swinging motions of the chain end, which might occur when the feeding means of the carriage is started, it is preferable to lower table 5 by means of the actuating cylinder 6, so that the next preceding link, while stationary, takes over the carrying of the link element from rollers 10. This way of operating saves time and reduces wear on the carriage transportation system. The carriage can be moved carefully with the link element oriented in its new position, i.e., with its axis in horizontal position, and the friction between the link element and the next preceding link will assures that the position of the link element is maintained.

As will be apparent from FIG. 2, the lowering of table 5 will also have the effect of positioning the link element and the next preceding link centrally in relation to each other, since the table is somewhat displaced laterally (because of linkage elements 4), the next preceding link thereby abutting and being guided along the left (as seen in FIG. 2) edges of recesses 21' so as to move into a well-defined, central position relative to the next preceding element being held stationary against end stop 23.

The entire operation can be made fully automatic by means of ordinary electrical conrol means.

I claim:

1. A method of revolving the last chain link element of a free hanging chain end, comprising the steps of (a) bringing said element into contact with a driving roller means located under said chain end by relative vertical movement between said element and said driving roller means;

(b) rotating said element in its own substantially vertical plane through frictional contact with said driving roller means, said driving roller means supporting said element during such rotation; and (c) terminating said contact upon completion of said rotating movement by relative vertical movement between said element and said driving roller means.

2. A method according to claim 1, wherein said chain end is first lowered towards said roller means, whereafter said chain end is hoisted.

3. A method according to claim 1, wherein said chain end is first lowered towards said roller means, whereafter said roller means is lowered.

4. A method according to claim 1, wherein said roller means is first elevated towards said chain end, whereafter the chain end is hoisted.

5. A method according to claim 1, wherein said roller means is first elevated towards said chain end, whereafter said roller means is lowered.

6. A method according to claim 1, wherein said chain link element is guided laterally during its rotary motion.

7. A method according to claim 1, wherein said chain link element during its rotary motion is brought into contact with at least one stop which limits the motion in the plane of said link.

8. A method according to claim 1, wherein the vertical position of said next preceding chain link is sensed for interrupting the relative motion of said chain end and said roller means at a relative position which makes the rotation of said last link element possible without interference from the previous links.

9. Apparatus for revolving the last chain link element of a free hanging chain end, comprising (a) driving roller means supporting said chain link element while causing it to rotate in its own substantially vertical plane; and (b) means for vertically moving said driving roller means and said chain end relative to one another to initiate and terminate contact between said chain link element and said driving roller means.

10. A device according to claim 9, wherein said roller means is mounted in a vertically movable support structure.

11. A device according to claim 9 wherein said roller means comprises a plurality of rollers at least one of which has a circumferential guide groove the cross section of which is adapted to the cross section of said chain link element.

12. A device according to claim 9, wherein said roller means comprises a plurality of synchronously operating driving rollers arranged next to each other on mutually parallel horizontal shafts, said rollers jointly constituting a driving roller bed.

13. A device according to claim 9, comprising lateral guides for said chain link element.

14. A device according to claim 13, wherein said lateral guides have recesses for receiving the lower end portion of the chain link next preceding said chain link element.

15. A device according to claim 9, comprising at least one stop element for limiting the motion of said chain link element in its plane.

16. A device according to claim 9, comprising sensing means for sensing the vertical position of the chain link next preceding said chain link element.

* * * * *